US006139601A

United States Patent [19]

Wernimont

[11] Patent Number: 6,139,601

[45] Date of Patent: Oct. 31, 2000

[54] METHOD OF RECYCLING SIMULTANEOUSLY A PLURALITY OF OIL FILTERS

[75] Inventor: Marvin Wernimont, Rembrandt, Iowa

[73] Assignee: Filter Recycling, Inc., Cherokee, Iowa

[21] Appl. No.: 09/418,735

[22] Filed: Oct. 15, 1999

Related U.S. Application Data

[62] Division of application No. 09/002,966, Jan. 5, 1998, Pat. No. 5,983,788.

[60] Provisional application No. 60/035,107, Jan. 13, 1997.

[51] Int. Cl.[7] ..... C22B 1/00

[52] U.S. Cl. ..... 75/401; 75/403; 75/414; 588/201; 100/37; 100/42; 100/902

[58] Field of Search ..... 75/401, 414, 403; 588/201; 100/37, 38, 42, 902

[56] References Cited

U.S. PATENT DOCUMENTS 3,106,888 10/1963 Chapleau ..... 100/232
5,125,331 6/1992 Wood ..... 100/37
5,174,199 12/1992 King et al. ..... 100/48
5,182,988 2/1993 Styfhoorn ..... 100/98 R
5,257,576 11/1993 Pearce et al. ..... 100/48
5,383,397 1/1995 Battles et al. ..... 100/51
5,983,788 11/1999 Wernimont ..... 100/125

*Primary Examiner*—Jill Warden
*Assistant Examiner*—Tima McGuthry-Banks
*Attorney, Agent, or Firm*—Zarley, McKee, Thomte, Voorhees & Sease

[57] ABSTRACT

A method of simultaneously recycling a plurality of used oil filters involves placing a plurality of the filters into a rectangular compartment having a top, opposite sides, a bottom, and first and second ends. Pressure is exerted on the oil filters in a first longitudinal direction, and a second compressive pressure is imposed on the filters in a second longitudinal direction at a substantial right angle with respect to the first longitudinal direction. The first and second pressures are sufficient to compress the air filters to a substantial self-contained rectangular block. This method produces a self-contained block wherein 90% to 95% of the residual oil in the filters is removed.

8 Claims, 5 Drawing Sheets

74
78
76
88
90
86
80
82
72
94
20
28
64
66
3
3
2
2
75
32
24
68
44
10
11
42
46
48
50
19
22
51
58
12
53
56
54
52

METHOD OF RECYCLING SIMULTANEOUSLY A PLURALITY OF OIL FILTERS

This application is based upon the applicant's PROVISIONAL APPLICATION SERIAL NO. 60/035,107 filed Jan. 13, 1997.

This application is a divisional of application Ser. No. 09/002,966 filed Jan. 5, 1998 now U.S. Pat. No. 5,983,788 issued on Nov. 16, 1999.

BACKGROUND OF THE INVENTION

Disposal of used oil filters presents a serious environmental problem for a number of reasons. First, they retain residual oil which can contaminate soil in landfills or the like. Further, they contain materials of different types such as metal, paper-like filter material, etc. which cannot be decomposed or are difficult to decompose.

Some attempts have been made to crush one or two filters at a time, but these devices do not meet the mass production requirements of the problem.

It is, therefore, a principal object of this invention to provide a press and a method for compressing a large number of filters at one time.

A further object of this invention is to provide a solid compressed mass or block of used filters that will hold a block-like shape, and which will hold a minimum amount of residual oil.

These and other objects will be apparent to those skilled in the art.

SUMMARY OF THE INVENTION

An apparatus for simultaneously recycling a plurality of used oil filters has a rectangular shaped compartment having a bottom, a top, opposite sides, and first and second ends. A first powered plunger is associated with the compartment above the top thereof to be moved downwardly toward the bottom to compress a plurality of used oil filters against the bottom. A second powered plunger is associated with the first end of the compartment and is adapted to be moved longitudinally in the compartment towards the second end. A dam member extends laterally across the compartment adjacent the second end so that the second powered plunger can compress a plurality of used oil filters against the dam member.

A method of simultaneously recycling a plurality of used oil filters involves placing a plurality of the filters into a rectangular compartment having a top, opposite sides, a bottom, and first and second ends. Pressure is exerted on the oil filters in a first longitudinal direction, and a second compressive pressure is imposed on the filters in a second longitudinal direction at a substantial right angle with respect to the first longitudinal direction. The first and second pressures are sufficient to compress the air filters to a substantial self-contained rectangular block. This method produces a self-contained block wherein 90% to 95% of the residual oil in the filters is removed.

DESCRIPTION OF THE PREFERRED EMBODIMENT

Figure 1:
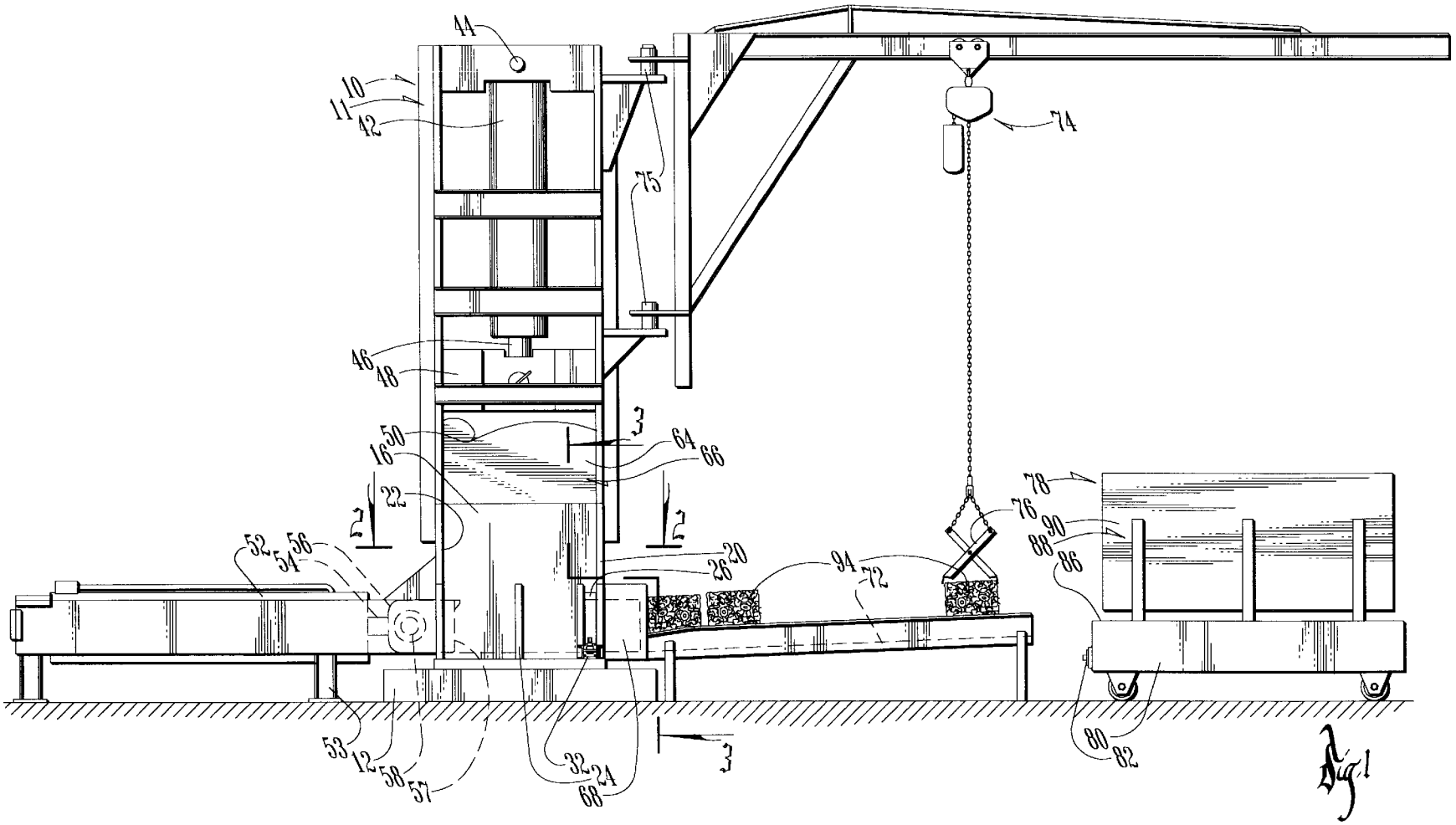
FIG. 1 is a side elevational view of the apparatus of this invention.

With reference to FIG. 1, press 10 has a frame 11 with a horizontal base 12 of rectangular configuration.

Figures 2, 3:
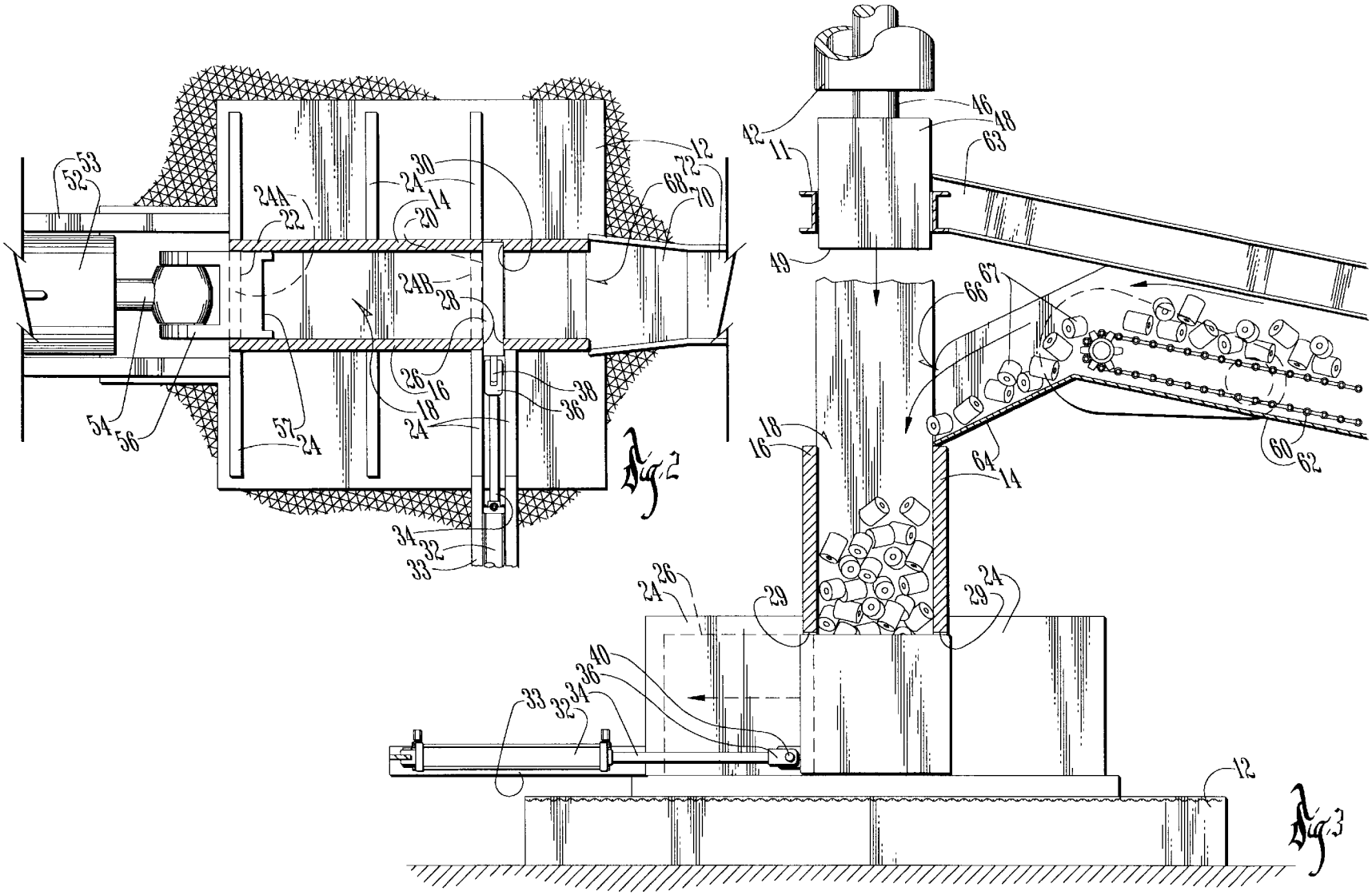
FIG. 2 is an enlarged scale sectional view taken on line 2—2 of FIG. 1.
FIG. 3 is an enlarged scale sectional view taken on line 3—3 of FIG. 2.
Figure 4:
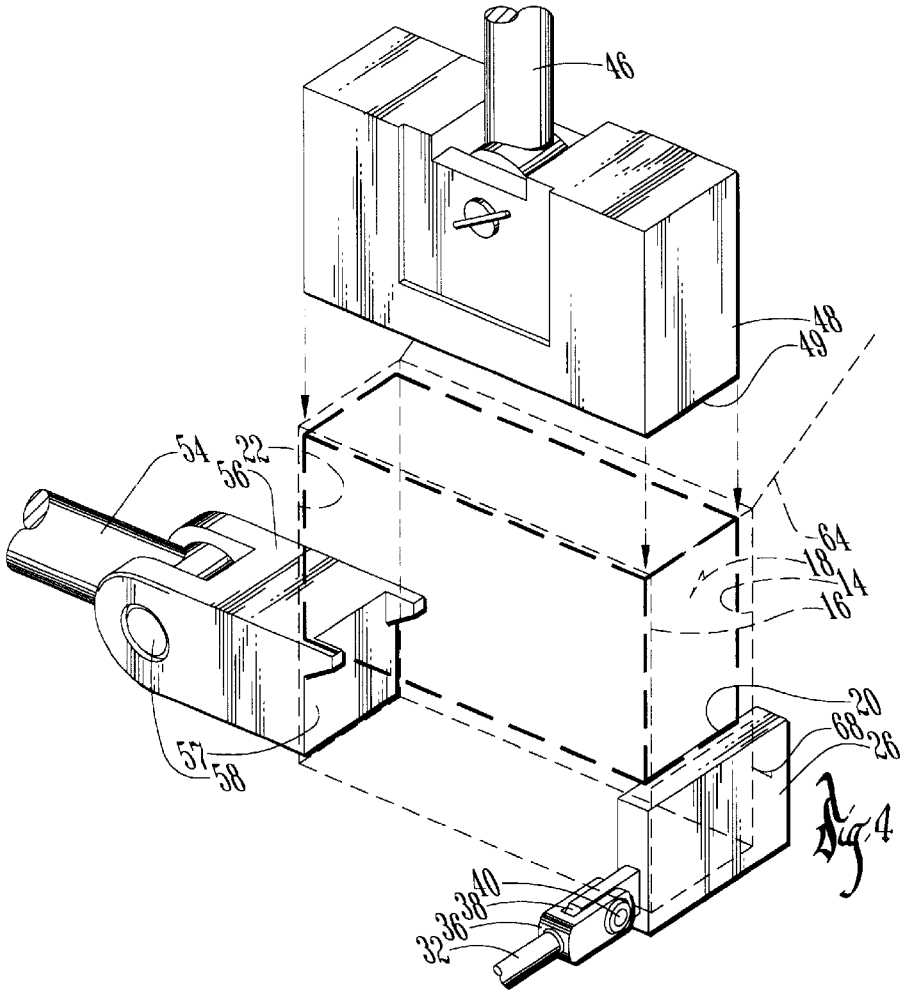
FIG. 4 is an enlarged scale exploded view of the compressive components as shown in FIG. 2.
Figure 5:
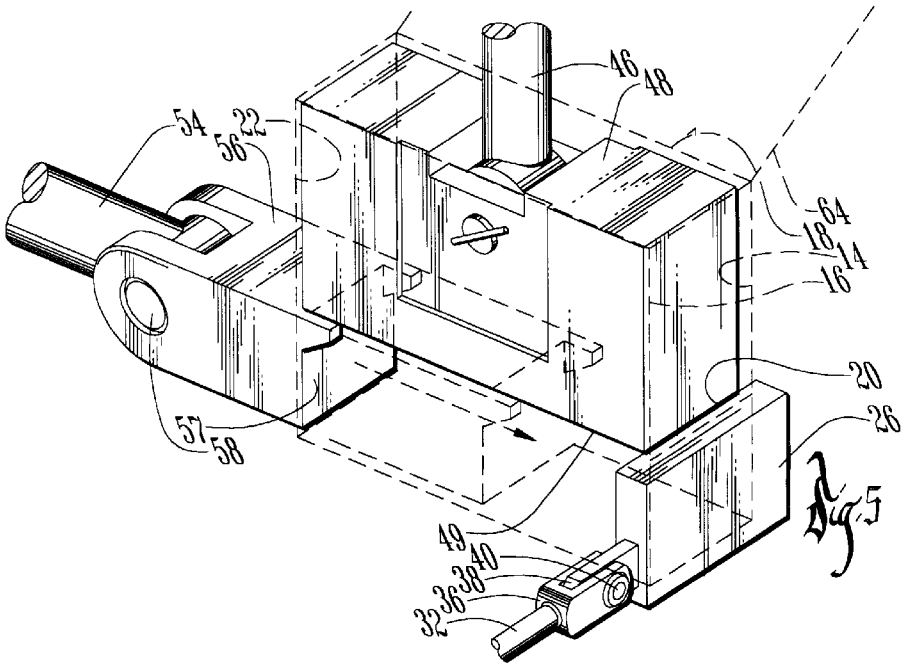
FIG. 5 is a view similar to that of FIG. 1 wherein the upper compressive force is being exerted in the compression compartment.
Figure 6:
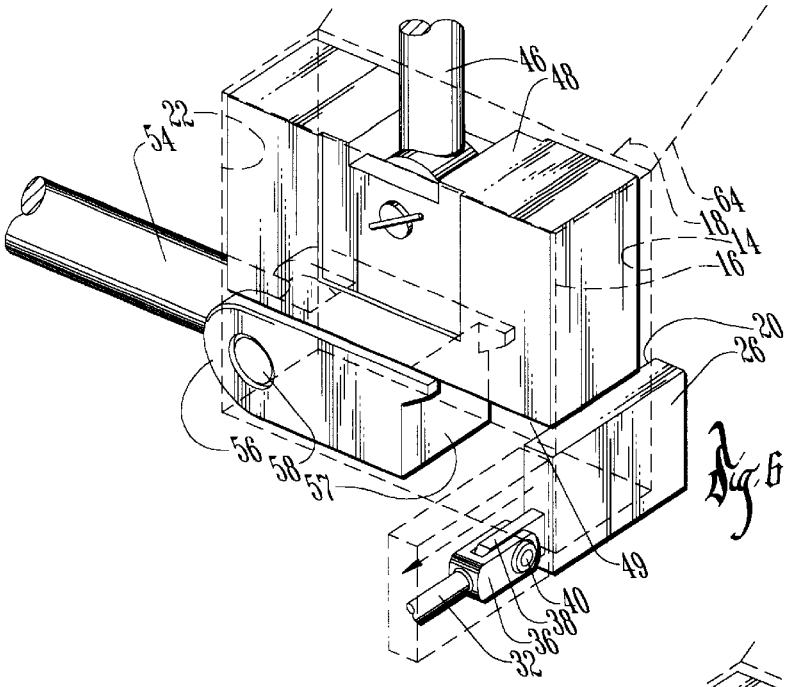
FIG. 6 is a view similar to that of FIG. 5 but shows the horizontal compressive force being exerted.
Figure 7:
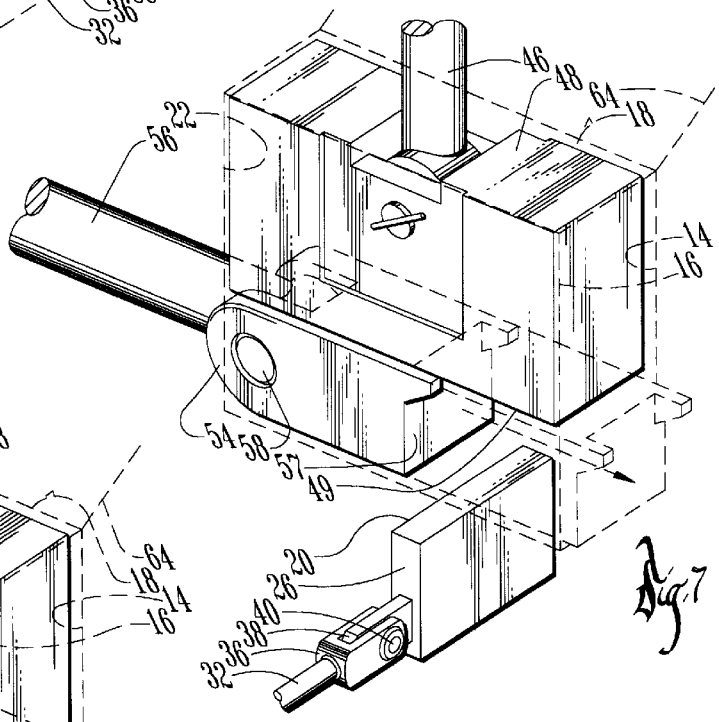
FIG. 7 is a view similar to that of FIG. 6 but shows the dam element being withdrawn from the compression compartment.
Figure 8:
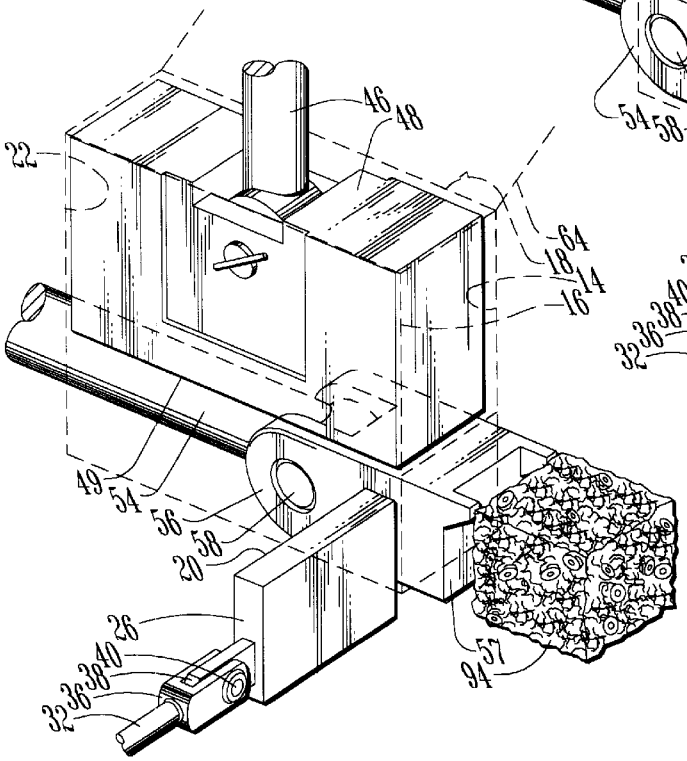
FIG. 8 is a view similar to that of FIG. 7 but shows the compressed block of oil filters being ejected from the compression compartment.

As best seen in FIG. 3, a pair of heavy steel spaced sidewalls 14 and 16 are welded or otherwise secured to base 12. Walls 14 and 16 are parallel to each other and define the sides of a compression compartment 18 which has ends 20 and 22. A plurality of braces or steel plates 24 are welded to base 12 and to the outer surfaces of sidewalls 16 and 18 for reinforcement purposes. A vertical end plate 24A is rigidly secured to the ends 22 of sidewall plates 14 and 16. As will be explained hereafter, the lower end of end plate 24A is raised a sufficient distance to create a space therebelow to receive a compression plunger which will be described hereafter. The plane of plate 24A defines the end 22 of compartment 18.

As also shown in FIG. 2, an end plate 24B is welded or otherwise secured to sidewalls 14 and 16 and extends transversely thereto. The portion of end plate 24B that extends between sidewalls 14 and 16 has a space therebelow to also receive a compression plunger which will be described hereafter.

A restrictor plate 26 (FIGS. 2 and 4–8) is adapted to be moved through slot 28 in sidewall 16 and slot 30 in sidewall 14. There is a slight crack or space 29 around plate 26 with respect to the slots 28 and 30 to permit residual oil within compartment 18 to escape the compartment. This will be discussed hereafter. Space 29 is best shown in FIG. 3.

A hydraulic cylinder 32 disposed in a horizontal position is secured in any convenient way to arm 33 (FIG. 3). Cylinder 32 has piston rod 34 with clevis 36 on the outer end thereof. Clevis 36 is pivotally mounted to bar 38 which extends outwardly from the bottom of restrictor plate 26. Pin 40 pivotally affixes the bar 38 to clevis 36.

A top cylinder 42 is mounted to the top of frame 11 by shaft 44 (FIG. 1). Cylinder 42 has a downwardly extending piston rod 46 which is connected in any conventional way to compression plunger 48 which has a horizontal face 49. Plunger 48 slidably moves in a vertical direction on guide frame 50 (FIG. 1).

A horizontal cylinder 52 is mounted on a sub frame 53 as best shown in FIG. 1. A conventional piston rod 54 extends outwardly from cylinder 52 and has a clevis plunger 56 on the outer end thereof. Plunger 56 has a vertical face 57 (FIGS. 4–8). Pin 58 pivotally interconnects piston rod 54 to clevis 56.

With reference to FIG. 3, a conventional chain conveyor 60 is mounted conventionally in housing 62 which is supposed by beam support 63. A chute 64 is in communication with the conveyor 60 and opening 66 to provide oil filters 67 to fall into compartment 18.

Figure 9:
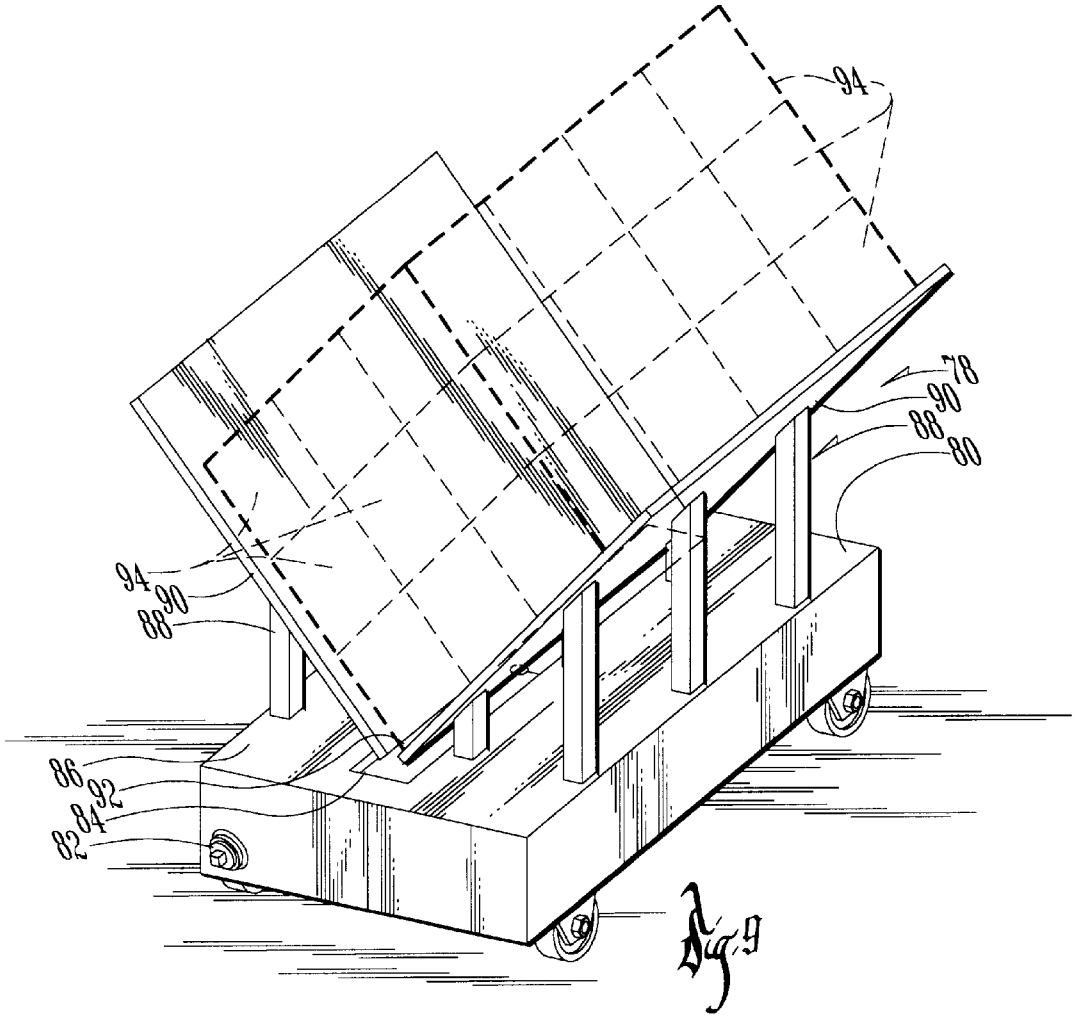
FIG. 9 is an elevational view of a draining apparatus for compressed cubes of oil filters.

With reference to FIGS. 1 and 2, a discharge opening 68 is located at the ends of sidewalls 14 and 16 downstream of restrictor plate 26. An inclined ramp 70 extends upwardly from discharge opening 68 and terminates in deck 72. A conventional hoist 74 is pivotally secured to frame 11 by hinges 75. A lazy tong grasping device 76 (FIG. 1) is adapted to grasp cubes of compressed oil filters as will be discussed hereafter for deposit on drain cart 78 (FIGS. 1 and 9). Drain cart 78 is comprised of a hollow tank 80 which has a conventional drain 82 in the lower end wall thereof. An elongated slot 84 appears in the top 86 of tank 80. A frame 88 is mounted on the upper surface of tank 80 and supports two V-shaped sides 90 which are positioned at approximately 90° with respect to each other. An elongated narrow space 92 exists between the lower horizontal edges of the sides 90.

The numeral 94 designates a block or cube of compressed oil filters which have been discharged from the press 10.

In operation, a plurality of used oil filters 67 are dumped into compression compartment 18 via conveyor 60. At that time, the restrictor plate 26, and compression plungers 48 and 56 are in the general positions shown in FIG. 4. The inner surface of restrictor plate 26 and the face 57 on plunger 56 define the ends of the chamber 18. The sidewalls 14 and 16, as previously described, define the sidewalls of the compression compartment 18. The cylinder 42 is actuated through any conventional control (not shown) to lower the compression plunger 48 downwardly into the top of compartment 18. The dimensions of the face 49 of plunger 48 coincide with the length and width of the compartment 18 as previously discussed. The piston 34 and plunger 48 of cylinder 42 are extended until the used filters in compartment 18 are vertically compressed to the desired height of the compressed filter block 94. With the plunger 48 in that position, the cylinder 52 is actuated so that the plunger 56 moves through the opening below end plate 24A and moves into the chamber 18 to compress the filters in compartment 18 against the restrictor plate 26. The plunger 56 is advanced sufficiently into compartment 18 to compress the filters to a length desired for the compressed filter block 94.

The residual oil in the filters 67 is forced out of the filters and escapes through the cracks or spaces 29 around the restrictor plate 26, as previously described. In excess of 90% of the residual oil in the used filters is removed in this manner. It is important that the compression of the filters take place first in a downwardly direction by plunger 48, and thereafter in a longitudinal direction by plunger 56 to make the cube 92 stay together. Simultaneous compression of the cube 94 in two directions will not work satisfactorily to bind the compressed oil filters together.

Next, the plungers 48 and 56 are then slightly withdrawn from chamber 18 to release the compressive forces against the cube 94.

The cylinder 32 is then actuated to slide restrictor plate 26 out of compartment 18. Then, cylinder 52 is actuated so that plunger 56 will push the cube 94 outwardly from between plates 14 and 16 through opening 68, thence up ramp 70, and onto deck 72. Hoist 74 can then be used to place the cube 94 on frame 88. Because of the inclined side 90 on frame 88, the cubes will be mounted on one edge thereof in an inclined position to facilitate the draining of any further residual oil therein downwardly through space 92 and thence through the slot 84 into the tank 80. The cubes are left on frame 88 for a sufficient period of time to allow all remaining residual oil which is free to flow to escape into tank 80.

It is preferable that a sump or suitable oil drainage system be located below press 10 so that oil escaping through spaces 29 from the compression compartment 18 will drain into such sump for collection and recycling. The blocks 94 are preferably crushed into the configuration of a cube having edge dimensions 12" to 18". After all of the residual oil has drained out of the crushed cubes by being positioned on frame 88 as described heretofore, or by any other convenient means, the cubes are then placed in a suitable receptacle and electrical current is passed therethrough to heat the cubes to an excessive temperature. This is normally done in a foundry. Because the blocks 94 are of high density, the small remaining amount of oil therein combusts and facilitates melting the metal in the compressed filters. An 18" cube will have produced approximately 1½ gallons of used oil in the above-described process, and will weigh approximately 150 pounds at the time it is placed in a receptacle for melting.

While being melted in the foundry, the rubber seals, paper, and oil remaining in the crushed filters vaporize, and the metal melts to be used in subsequent products. The ignition of any remaining oil enhances the heat for melting and reduces the electrical power required for the meltdown process. As described above, the oil and sludge that are squeezed out of the blocks 92 in their creation go into settling bins or basins whereby the residual oil is accumulated for other uses. Again, approximately 90% to 95% of the residual oil in the original used oil filter is removed in the foregoing process. The slot 28 for restrictor plate 26 is approximately 4" wide and 12" high. The restrictor plate 26 is preferably in the order of 18" long and just slightly less than 4" wide to establish the clearance or space 29 described above. The lateral distance between sidewalls 14 and 16 can be from 12" to 18". The longitudinal distance between restrictor plate 26 and the end 22 of compartment 18 is typically 36". The used filters 67 are typically compressed such that the height of the block 92 equals the width thereof which would be in the order of 12" to 18". The plungers 48 and 56 preferably exert a pressure on the oil filters in the compartment of approximately 2900–3200 pounds per square inch.

It is, therefore, seen that the apparatus and method of this invention will permit substantial recycling of all the components of a used oil filter wherein all of the metal is salvaged, most of the residual oil is salvaged, and the rubber seals, paper and the like are incinerated in the melt down process.

It is, therefore, seen that this invention would achieve at least all of its stated objectives.

I claim:

1. A method of recycling simultaneously a plurality of used oil filters including at least a deformable housing and a quantity of residual oil therein, comprising the steps of:

placing a plurality of said oil filters into a rectangular compartment having a top, opposite sides, a bottom, and first and second ends and exerting a first compressive pressure on said oil filters in a first longitudinal direction, exerting a second compressive pressure on said filters in a second longitudinal direction at a substantial right angle with respect to said first longitudinal direction, said first and second compressive pressures being sufficient to compress said oil filters into a substantial self-contained rectangular block.

2. The method of claim 1 wherein most but not all of said residual oil is forcibly removed from said oil filters by said first and second compressive pressures.

3. The method of claim 2 wherein said block is placed in a vat for molten metal, applying heat to initiate melting of said block and wherein the residual oil provides supplemental energy to cause said block to become molten.

4. The method of claim 2 wherein said first and second compressing pressures exert pressure on said oil filters of approximately 2900–3200 pounds per square inch.

5. The method of claim 2 wherein 90–95% of said residual oil is removed.

6. The method of claim 1 wherein the said second compressive pressure is exerted in a direction from one of said ends of said compartment towards the other of said ends; and the first compressive force is exerted in a direction from the top of said compartment towards said bottom.

7. The method of claim 1 comprising the further step of releasing said first and second compressive pressures, and thence pushing said rectangular block out of said compartment.

8. The method of claim 7 wherein said block is tilted to a position wherein an edge thereof defined by the intersection of two exterior angularly disposed planar surfaces on said block is in a substantial horizontal position to allow some but not all of said residual oil to drain from said block.

* * * * *